US009287641B2

(12) United States Patent
Kato et al.

(10) Patent No.: US 9,287,641 B2
(45) Date of Patent: Mar. 15, 2016

(54) CONNECTOR, METHOD OF MANUFACTURING CONNECTOR, AND FLAT CABLE WITH CONNECTOR

(71) Applicant: ACES ELECTRONICS CO., LTD., Zhongli, Taoyuan County (TW)

(72) Inventors: Nobukazu Kato, Fussa (JP); Norio Yoshida, Atsugi (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 14/301,993

(22) Filed: Jun. 11, 2014

(65) Prior Publication Data

US 2014/0378001 A1 Dec. 25, 2014

(30) Foreign Application Priority Data

Jun. 19, 2013 (JP) ..... 2013-128124

(51) Int. Cl.

*H01R 12/24* (2006.01)
*H01R 12/71* (2011.01)
*H01R 12/79* (2011.01)
*H01R 12/72* (2011.01)

(52) U.S. Cl.

CPC ..... *H01R 12/716* (2013.01); *H01R 12/79* (2013.01); *H01R 12/72* (2013.01); *Y10T 29/49174* (2015.01)

(58) Field of Classification Search

CPC ..... H01R 12/78; H01R 12/79; H01R 1/774; H01R 12/592; H01R 23/668; H01R 23/7068; H01R 12/57; H01R 12/62
USPC ..... 439/629, 495, 496, 637, 628
See application file for complete search history.

(56) References Cited

U.S. PATENT DOCUMENTS 5,370,552 A * 12/1994 Chishima et al. ..... 439/495
5,525,072 A * 6/1996 Kunishi ..... H01R 12/57 439/495
5,906,504 A * 5/1999 Igarashi ..... H01R 12/79 439/495
6,210,209 B1 * 4/2001 Wu ..... H01R 12/79 439/495
6,231,378 B1 * 5/2001 Wu et al. ..... 439/495
6,371,797 B1 * 4/2002 Kikuchi et al. ..... 439/495
7,059,893 B2 * 6/2006 Ono ..... H01R 12/592 439/260
7,374,451 B2 * 5/2008 Wei ..... H01R 12/774 439/494
7,674,134 B2 * 3/2010 Yamaji et al. ..... 439/607.53
7,980,864 B2 * 7/2011 Huang ..... H01R 12/79 439/260
8,870,600 B2 * 10/2014 Wu ..... H01R 13/05 439/637
2004/0063344 A1 4/2004 Shin

FOREIGN PATENT DOCUMENTS

JP 3898643 B2 3/2007
* cited by examiner

*Primary Examiner* — Neil Abrams
*Assistant Examiner* — Travis Chambers
(74) *Attorney, Agent, or Firm* — Chiesa Shahinian & Giantomasi PC

(57) ABSTRACT

In a connector including: a housing having a first fitting portion and a second fitting portion to which a flat cable and mating connector are fitted, respectively; and a contact held in the housing and having a first contacting portion a second contacting portion making contact with the flat cable and mating connector, respectively, the contact has first and second arm portions, one end of the first arm portion connects to one end of the second arm portion with a U-shaped portion, a non-connection sides of the first and arm portions interpose the flat cable, the first contacting portion is provided at or in the vicinity of a tip of the first arm portion, and the second contacting portion is formed on at least one of the first and second arm portions and is positioned between the U-shaped portion and the tips of the first and second arm portions.

10 Claims, 6 Drawing Sheets

CONNECTOR, METHOD OF MANUFACTURING CONNECTOR, AND FLAT CABLE WITH CONNECTOR

CROSS-REFERENCE TO RELATED APPLICATIONS

This application claims priority to Japanese Patent Application No. 2013-128124, filed on Jun. 19, 2013, which is incorporated herein by reference in its entirety.

BACKGROUND OF THE INVENTION

The present invention relates to a connector, which electrically connects two circuit boards to each other, a method of manufacturing the connector, and a flat cable with connector. Conventionally, a board-to-board connector has been used to electrically connect a pair of circuit boards, which are disposed in parallel to each other, to each other. In such a board-to-board connector, a first board is electrically connected to a second board in such a manner that a receptacle connector mounted on the second board is fitted to a plug connector mounted on the first board.

However, in the case of fitting the receptacle connector to the plug connector using the above-described board-to-board connector, since the plug connector and the receptacle connector are located between the first board and the second board, it was not easy that the receptacle connector was accurately fitted to the plug connector.

SUMMARY OF THE INVENTION

An object of the present invention is to provide a connector which can be easily fitted with a mating connector, a method of manufacturing the connector, and a flat cable with connector.

A connector of the present invention includes: a housing including a first fitting portion to which a flat cable is fitted and a second fitting portion to which a mating connector is fitted; and a contact that is held in the housing and includes a first contacting portion making contact with the flat cable and a second contacting portion making contact with the mating connector, wherein the contact has a first arm portion and a second arm portion facing each other, one end of the first arm portion and one end of the second arm portion are connected to each other with a U-shaped portion, the flat cable is interposed in a thickness direction at a non-connection side of the first arm portion and the second arm portion, and the first contacting portion is provided at a tip of the first arm portion or in the vicinity of the tip of the first arm portion, and the second contacting portion is formed on at least one of the first arm portion and the second arm portion and is positioned between the U-shaped portion and the tips of the first arm portion and the second arm portion.

A connector of the present invention includes: a housing including a first fitting portion to which a flat cable is fitted and a second fitting portion to which a mating connector is fitted; and a contact that is held in the housing and includes a first contacting portion making contact with the flat cable and a second contacting portion making contact with the mating connector, wherein the contact has a first arm portion and a second arm portion facing each other, one end of the first arm portion and one end of the second arm portion are connected to each other with a U-shaped portion, the U-shaped portion has a bending portion which is bent toward the mating connector to be fitted in a thickness direction of the flat cable, the flat cable is interposed in the thickness direction at a non-connection side of the first arm portion and the second arm portion, and the first contacting portion is provided at a tip of the first arm portion or in the vicinity of the tip of the first arm portion, the bending portion is positioned nearer the mating connector in the thickness direction of the flat cable than the non-connection side of the first arm portion and the second arm portion, and the second contacting portion is formed on at least one of the first arm portion and the second arm portion of the bending portion.

A connector of the present invention includes: a housing including a first fitting portion to which a flat cable is fitted and a second fitting portion to which a mating connector is fitted; a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein both of the first contact and the second contact have a substantially L-shape, the flat cable is interposed between the first contacting portion formed at one side of the first contact and the third contacting portion formed at one side of the second contact, and further the second contacting portion is formed between a tip of the other side of the first contact extending in a thickness direction of the flat cable and a bending portion having a substantially L-shape to make contact with the mating connector, and the fourth contacting portion is formed between a tip of the other side of the second contact extending in the thickness direction of the flat cable and a bending portion having a substantially L-shape to make contact with the mating connector.

A connector of the present invention includes: a housing including a first fitting portion to which a flat cable is fitted and a second fitting portion to which a mating connector is fitted; a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein the first contact has a first arm portion and a second arm portion facing each other, one end of the first arm portion and one end of the second arm portion are connected to each other with a U-shaped portion, the flat cable is interposed in a thickness direction at a non-connection side of the first arm portion and the second arm portion, and the first contacting portion is provided at a tip of the first arm portion or in the vicinity of the tip of the first arm portion, the second contacting portion is formed on at least one of the first arm portion and the second arm portion and is positioned between the U-shaped portion and the tips of the first arm portion and the second arm portion, and the second contact has a substantially L-shape, the flat cable is interposed between the first contacting portion formed on the first arm portion of the first contact and the third contacting portion formed at one side of the second contact, and further the fourth contacting portion is formed between a tip of the other side of the second contact extending in the thickness direction of the flat cable and a bending portion having a substantially L-shape to make contact with the mating connector.

A connector includes: a housing including a first fitting portion to which a flat cable is fitted and a second fitting portion to which a mating connector is fitted; a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein the first contact has a first arm portion and a second arm portion facing each other, one end of the first arm portion and one end of the second arm portion are connected to each other with a U-shaped portion, the U-shaped portion has a bending portion which is bent toward the mating connector to be fitted in a thickness direction of the flat cable, the flat cable is interposed in the thickness direction at a non-connection side of the first arm portion and the second arm portion, and the first contacting portion is provided at a tip of the first arm portion or in the vicinity of the tip of the first arm portion, the bending portion is positioned nearer the mating connector in the thickness direction of the flat cable than the non-connection side of the first arm portion and the second arm portion, the second contacting portion is formed on at least one of the first arm portion and the second arm portion of the bending portion, and the second contact has a substantially L-shape, the flat cable is interposed between the first contacting portion formed on the first arm portion of the first contact and the third contacting portion formed at one side of the second contact, and further the fourth contacting portion is formed between a tip of the other side of the second contact extending in the thickness direction of the flat cable and a bending portion having a substantially L-shape to make contact with the mating connector.

In the connector of the present invention, the second contact is insert-molded in the housing.

In the connector of the present invention, a shell component is provided to cover the housing.

A method of manufacturing the connector of the present invention includes: preparing the housing; fitting the flat cable to the first fitting portion; and attaching the contact to the housing.

A method of manufacturing the connector of the present invention includes: preparing the housing in which the second contact is provided; fitting the flat cable to the first fitting portion; and attaching the first contact to the housing.

A flat cable with connector of the present invention includes in which the flat cable is fitted to the first fitting portion of the connector.

In the flat cable with connector of the present invention, a shell component is provided to cover the housing.

According to the present invention, it is possible to provide a connector which can be easily fitted with a mating connector, a method of manufacturing the connector, and a flat cable with connector.

DETAILED DESCRIPTION

Figure 1:
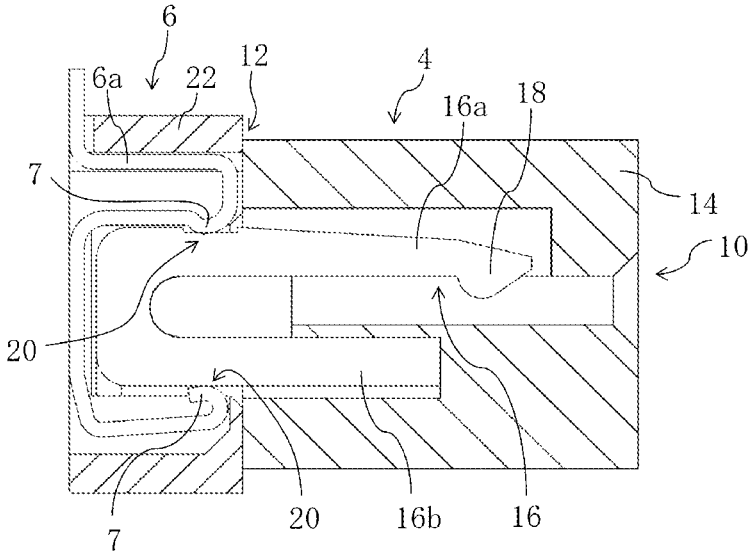
FIG. 1 is a cross-sectional view illustrating a state where a receptacle connector is fitted to a plug connector according to a first embodiment.
Figure 2:
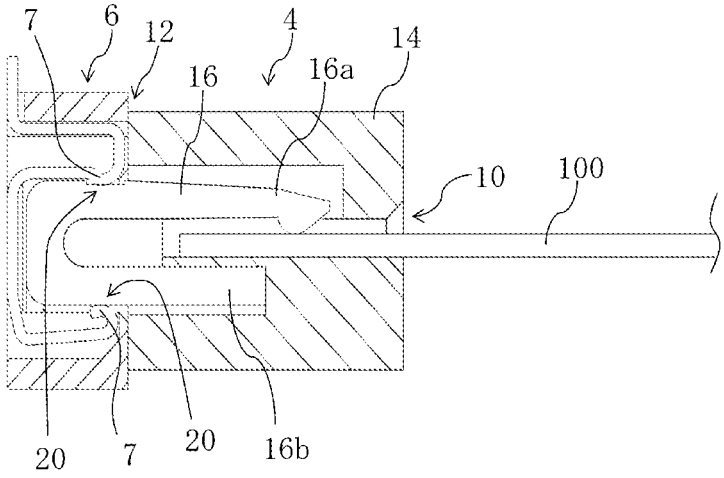
FIG. 2 is a cross-sectional view illustrating a state where a flat cable is fitted to the plug connector and the receptacle connector is fitted to the plug connector according to the first embodiment.

Hereinafter, connectors (plug connectors) according to embodiments of the present invention will be described with reference to the drawings. FIG. 1 is a cross-sectional view illustrating a state where a receptacle connector is fitted to a plug connector according to a first embodiment, and FIG. 2 is a cross-sectional view illustrating a state where a flat cable is fitted to the plug connector and the receptacle connector is fitted to the plug connector.

As illustrate in FIG. 1, a plug connector 4 is provided with a housing 14 including a first fitting portion 10 to which a flat cable 100 is fitted and a second fitting portion 12 to which a receptacle connector 6 is fitted. In the plug connector 4, the first fitting portion 10 is provided at one end of the housing 14 and the second fitting portion 12 is provided at the other end such that a fitting direction thereof is opposing to that of the first fitting portion 10.

The housing 14 holds a contact 16 which includes a first arm portion 16*a* extending in a direction of the first fitting portion 10 and a second arm portion 16*b* extending in the direction of the first fitting portion 10 and facing the first arm portion 16*a*. One end of the first arm portion 16*a* and one end of the second arm portion 16*b* are connected to each other with a U-shaped portion, and a flat cable 100 is interposed between the other end of the first arm portion 16*a* and the other end of the second arm portion 16*b*, which are a non-connection side, in a thickness direction. A first contacting portion 18 is provided at the tip of the first arm portion 16*a* of the contact 16 to make contact with the flat cable 100. In addition, two second contacting portions 20 are provided in the vicinity of the U-shaped portion of the first arm portion 16*a* and the second arm portion 16*b* to make contact with a contact 6*a* of the receptacle connector 6 mounted on a circuit board not illustrated.

The contact 6*a* of the receptacle connector 6 is held in a housing 22 and has a shape which is bent in U-shape. Two contacting points 7 are formed in the contact 6*a* to make contact with the second contacting portions 20 formed in the contact 16 of the plug connector 4.

In the case of manufacturing a flat cable with connector which is formed by fitting the flat cable 100 to the plug connector 4 according to the first embodiment, first, the housing 14 is prepared and the flat cable 100 is fitted to the first fitting portion 10. Subsequently, the contact 16 is attached to the housing 14 such that the flat cable 100 is interposed between the first arm portion 16*a* and the second arm portion 16*b* of the contact 16. Thus, the flat cable with connector, which is formed by fitting the flat cable 100 to the first fitting portion 10 of the plug connector 4, is manufactured. Further, a process may be further provided to attach a shell component covering the housing 14 of the plug connector 4.

In the case of fitting the plug connector 4 and the receptacle connector 6, the receptacle connector 6 is fitted to the second fitting portion 12 of the plug connector 4. Thus, the contact 16 of the plug connector 4 is interposed by two contacting points 7 of the contact 6*a* of the receptacle connector 6, and two contacting points 7 are connected to two second contacting portions 20, respectively. In this case, since there is no possibility that the second fitting portion 12 formed in the plug connector 4 is hidden by the flat cable 100 fitted to the plug connector 4 or the circuit board on which the receptacle connector 6 is mounted, the plug connector 4 and the receptacle connector 6 can be easily fitted to each other.

Further, in the first embodiment, the first contacting portion 18 is provided at the tip of the first arm portion 16*a* to make contact with the flat cable 100, but the first contacting portion 18 may be provided in the vicinity of the tip of the first arm portion 16*a*.

Moreover, in the first embodiment, the second contacting portions 20 are provided in the vicinity of the U-shaped portion of the first arm portion 16*a* and the second arm portion 16*b*, but the second contacting portion 20 may be positioned between the U-shaped portion and the tip of the first arm portion 16*a* and between the U-shaped portion and the tip of the second arm portion 16*b*, and the second contacting portion 20 may be provided in either of the first arm portion 16*a* and the second arm portion 16*b*.

Figure 3:
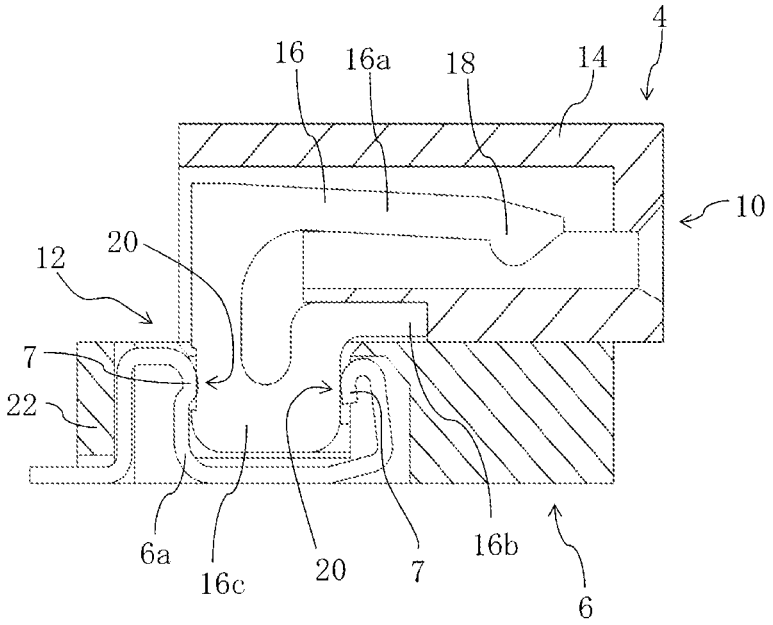
FIG. 3 is a cross-sectional view illustrating a state where a receptacle connector is fitted to a plug connector according to a second embodiment.
Figure 4:
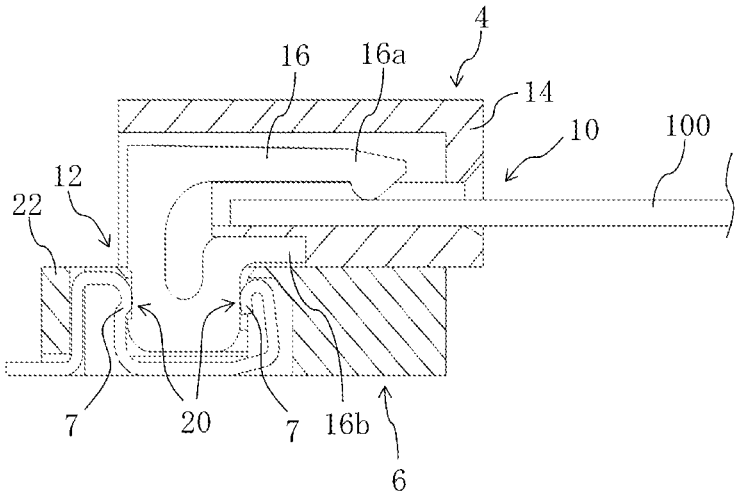
FIG. 4 is a cross-sectional view illustrating a state where a flat cable is fitted to the plug connector and the receptacle connector is fitted to the plug connector according to the second embodiment.

Next, a connector (plug connector) according to a second embodiment of the present invention will be described below. FIG. 3 is a cross-sectional view illustrating a state where a receptacle connector is fitted to a plug connector according to a second embodiment, and FIG. 4 is a cross-sectional view illustrating a state where a flat cable is fitted to the plug connector and the receptacle connector is fitted to the plug connector. Further, in the description of the second embodiment, the description will be provided while the same components as in the first embodiment are denoted by the reference numerals used in the description of the first embodiment.

As illustrated in FIG. 3, a plug connector 4 is provided with a housing 14 including a first fitting portion 10 to which a flat cable 100 is fitted and a second fitting portion 12 to which a receptacle connector 6 is fitted. In the plug connector 4, the first fitting portion 10 is provided at one end of the housing 14 and the second fitting portion 12 is provided at the other end such that a fitting direction thereof is orthogonal to the fitting direction of the first fitting portion 10.

The housing 14 holds a contact 16 which includes a first arm portion 16*a* extending in a direction of the first fitting portion 10 and a second arm portion 16*b* extending in the direction of first fitting portion 10 and facing the first arm portion 16*a*. One end of the first arm portion 16*a* and one end of the second arm portion 16*b* are connected to each other with a U-shaped portion. Here, the U-shaped portion constitutes a bending portion 16*c* which is bent toward the receptacle connector 6 to be fitted in a thickness direction of the flat cable 100. The flat cable 100 is interposed between the other end of the first arm portion 16*a* and the other end of the second arm portion 16*b*, which are a non-connection side, in a thickness direction. Further, the bending portion 16*c* is positioned nearer the receptacle connector 6 in the thickness direction of the flat cable 100 than the non-connection side of the first arm portion 16*a* and the second arm portion 16*b*.

A first contacting portion 18 is provided at the tip of the first arm portion 16*a* of the contact 16 to make contact with the flat cable 100. In addition, two second contacting portions 20 are provided in the bending portion 16*c* of the U-shaped portion of the first arm portion 16*a* and the second arm portion 16*b* to make contact with a contact 6*a* of the receptacle connector 6 mounted on a circuit board not illustrated.

The contact 6*a* of the receptacle connector 6 is held in the housing 22 and has a shape which is bent in U-shape. Two contacting points 7 are formed in the contact 6*a* to make contact with the second contacting portions 20 formed in the contact 16 of the plug connector 4.

In the case of manufacturing a flat cable with connector which is formed by fitting the flat cable 100 to the plug connector 4 according to the second embodiment, first, the housing 14 is prepared and the flat cable 100 is fitted to the first fitting portion 10. Subsequently, the contact 16 is attached to the housing 14 such that the flat cable 100 is interposed between the first arm portion 16*a* and the second arm portion 16*b* of the contact 16. Thus, the flat cable with connector, which is formed by fitting the flat cable 100 to the first fitting portion 10 of the plug connector 4, is manufactured. Further, a process may be further provided to attach a shell component covering the housing 14 of the plug connector 4.

In the case of fitting the plug connector 4 and the receptacle connector 6, the receptacle connector 6 is fitted to the second fitting portion 12 of the plug connector 4. Thus, the contact 16 of the plug connector 4 is interposed by two contacting points 7 of the contact 6*a* of the receptacle connector 6, and two contacting points 7 are connected to two second contacting portions 20, respectively. In this case, since there is no possibility that the second fitting portion 12 formed in the plug connector 4 is hidden by the flat cable 100 fitted to the plug connector 4 or the circuit board on which the receptacle connector 6 is mounted, the plug connector 4 and the receptacle connector 6 can be easily fitted to each other.

Further, in the second embodiment, the first contacting portion 18 is provided at the tip of the first arm portion 16*a* to make contact with the flat cable 100, but the first contacting portion 18 may be provided in the vicinity of the tip of the first arm portion 16*a*.

Moreover, in the second embodiment, two second contacting portions 20 are provided at the bending portion 16*c* of the U-shaped portion of the first arm portion 16*a* and the second arm portion 16*b*, but the second contacting portion 20 may be provided in either of the first arm portion 16*a* and the second arm portion 16*b*.

Figure 5:
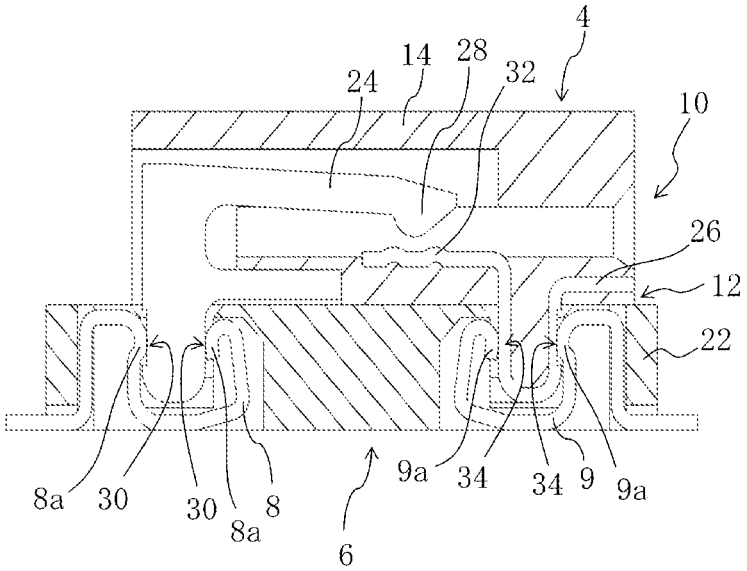
FIG. 5 is a cross-sectional view illustrating a state where a receptacle connector is fitted to a plug connector according to a third embodiment.
Figure 6:
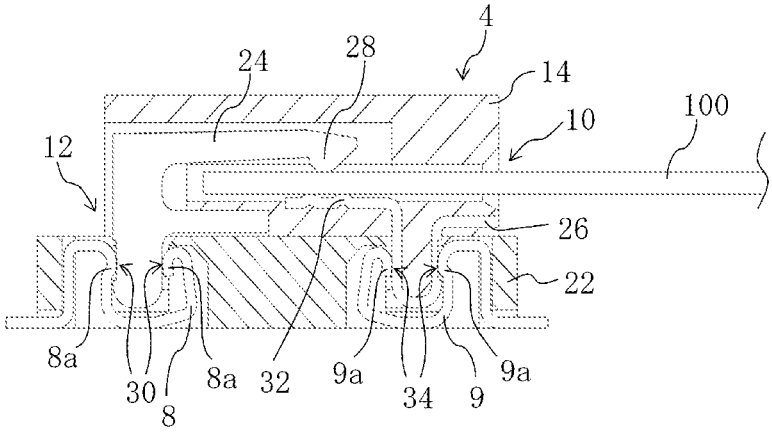
FIG. 6 is a cross-sectional view illustrating a state where a flat cable is fitted to the plug connector and the receptacle connector is fitted to the plug connector according to the third embodiment.

A connector (plug connector) according to a third embodiment of the present invention will be described below. FIG. 5 is a cross-sectional view illustrating a state where a receptacle connector is fitted to a plug connector according to a third embodiment, and FIG. 6 is a cross-sectional view illustrating a state where a flat cable is fitted to the plug connector and the receptacle connector is fitted to the plug connector. Further, in the description of the third embodiment, the description will be provided while the same components as in the first embodiment are denoted by the reference numerals used in the description of the first embodiment.

As illustrated in FIG. 5, a plug connector 4 is provided with a housing 14 including a first fitting portion 10 to which a flat cable 100 is fitted and a second fitting portion 12 to which a receptacle connector 6 is fitted. In the plug connector 4, the first fitting portion 10 is provided at one end of the housing 14 and the second fitting portion 12 is provided such that a fitting direction thereof is orthogonal to the fitting direction of the first fitting portion 10.

The housing 14 holds a first contact 24 which has a substantially L-shape and a second contact 26 which has a substantially L-shape. A first contacting portion 28 is formed at a tip portion of one side of the first contact 24 to make contact with a front surface of the flat cable 100, and two second contacting portions 30 are formed between a tip of the other side of the first contact 24, which extends in a thickness direction of the flat cable 100, and a bending portion having a substantially L-shape to make contact with a first contact 8 of the receptacle connector 6 mounted on a circuit board not illustrated. A third contacting portion 32 is formed at a tip portion of one side of the second contact 26 to make contact with a back surface of the flat cable 100. A U-shaped portion, which is bent in a U-shape, is formed at the tip of the other side of the second contact 26, which extends in the thickness direction of the flat cable 100. Two fourth contacting portions 34 are formed in the U-shaped portion to make contact with a second contact 9 of the receptacle connector 6 mounted on the circuit board not illustrated. Here, the fourth contacting portions 34 are positioned between the tip of the U-shaped portion and the bending portion having the substantially L-shape.

The first contact 8 of the receptacle connector 6 is held in the housing 22 and has a shape which is bent in U-shape. Two contacting points 8*a* are formed in the first contact 8 to make contact with two second contacting portions 30 formed in the first contact 24 of the plug connector 4. In addition, the second contact 9 of the receptacle connector 6 is held in the housing 22 and has a shape which is bent in U-shape. Two contacting points 9*a* are formed in the second contact 9 to make contact with two fourth contacting portions 34 formed in the second contact 26 of the plug connector 4.

In the case of manufacturing a flat cable with connector which is formed by fitting the flat cable 100 to the plug connector 4 according to the third embodiment, first, the housing 14 into which the second contact 26 is insert-molded is prepared and the flat cable 100 is fitted to the first fitting portion 10. Subsequently, the first contact 24 is attached to the housing 14 such that the flat cable 100 is interposed between the first contacting portion 28 of the first contact 24 and the third contacting portion 32 of the second contact 26. Thus, the flat cable with connector, which is formed by fitting the flat cable 100 to the first fitting portion 10 of the plug connector 4, is manufactured. Further, a process may be further provided to attach a shell component covering the housing 14 of the plug connector 4.

In the case of fitting the plug connector 4 and the receptacle connector 6, the receptacle connector 6 is fitted to the second fitting portion 12 of the plug connector 4. Thus, two contacting points 8*a* of the first contact 8 of the receptacle connector 6 are connected to two second contacting portions 30 of the first contact 24 of the plug connector 4, respectively. In addition, two contacting points 9*a* of the second contact 9 of the receptacle connector 6 are connected to two second contacting portions 20 of the second contact 26 of the plug connector 4, respectively.

In this case, since there is no possibility that the second fitting portion 12 formed in the plug connector 4 is hidden by the flat cable 100 fitted to the plug connector 4 or the circuit board on which the receptacle connector 6 is mounted, the plug connector 4 and the receptacle connector 6 can be easily fitted to each other.

Further, in the third embodiment, the first contacting portion 28 is provided at the tip of the first contact 24 to make contact with the flat cable 100, but the first contacting portion 28 may be provided in the vicinity of the tip of the first contact 24.

Further, the first contact according to the third embodiment described above may be changed into the contact according to the second embodiment. In this case, the first contact has the first arm portion and the second arm portion facing each other, one end of the first arm portion and one end of the second arm portion are connected to each other with the U-shaped portion, and the U-shaped portion has the bending portion which is bent toward the receptacle connector 6 to be fitted in the thickness direction of the flat cable 100. The flat cable 100 is interposed in the thickness direction at the non-connection side of the first arm portion and the second arm portion, the first contacting portion is provided at the tip of the first arm portion or in the vicinity of the tip of the first arm portion, and the bending portion is positioned nearer the receptacle connector 6 in the thickness direction of the flat cable 100 than the non-connection side of the first arm portion and the second arm portion. In addition, the second contacting portion is formed on at least one of the first arm portion and the second arm portion of the bending portion. Here, the second contacting portion may be positioned between at least one U-shaped portion of the first arm portion and/or the second arm portion and the tips of the first arm portion and the second arm portion.

The above-described embodiments are described to facilitate understanding of the present invention and are not to limit the invention. Accordingly, respective elements disclosed in the above embodiments include all design modifications and equivalents belonging to the technical scope of the present invention.

The invention claimed is:

1. A connector comprising:

a housing including a first fitting portion to which a flat cable is fitted and a second fitting portion to which a mating connector is fitted; and a contact that is held in the housing and includes a first contacting portion making contact with the flat cable and a second contacting portion making contact with the mating connector, wherein the contact has a first arm portion and a second arm portion facing each other, one end of the first arm portion and one end of the second arm portion are connected to each other with a U-shaped portion, the U-shaped portion has a bending portion which is bent toward the mating connector to be fitted in a thickness direction of the flat cable, the flat cable is interposed in the thickness direction at a non-connection side of the first arm portion and the second arm portion, and the first contacting portion is provided at a tip of the first arm portion or in the vicinity of the tip of the first arm portion, the bending portion is positioned nearer the mating connector in the thickness direction of the flat cable than the non-connection side of the first arm portion and the second arm portion, and the second contacting portion is formed on at least one of the first arm portion and the second arm portion of the bending portion.

2. A connector comprising:

a housing including a first fitting portion to which a flat cable is fitted and a second fitting portion to which a mating connector is fitted;

a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein both of the first contact and the second contact have a substantially L-shape, the flat cable is interposed between the first contacting portion formed at one side of the first contact and the third contacting portion formed at one side of the second contact, and further the second contacting portion is formed between a tip of the other side of the first contact extending in a thickness direction of the flat cable and a bending portion having a substantially L-shape to make contact with the mating connector, and the fourth contacting portion is formed between a tip of the other side of the second contact extending in the thickness direction of the flat cable and a bending portion having a substantially L-shape to make contact with the mating connector.

3. A connector comprising:

a housing including a first fitting portion to which a flat cable is fitted and a second fitting portion to which a mating connector is fitted;

a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein the first contact has a first arm portion and a second arm portion facing each other, one end of the first arm portion and one end of the second arm portion are connected to each other with a U-shaped portion, the flat cable is interposed in a thickness direction at a non-connection side of the first arm portion and the second arm portion, and the first contacting portion is provided at a tip of the first arm portion or in the vicinity of the tip of the first arm portion, the second contacting portion is formed on at least one of the first arm portion and the second arm portion and is positioned between the U-shaped portion and the tips of the first arm portion and the second arm portion, and the second contact has a substantially L-shape, the flat cable is interposed between the first contacting portion formed on the first arm portion of the first contact and the third contacting portion formed at one side of the second contact, and further the fourth contacting portion is formed between a tip of the other side of the second contact extending in the thickness direction of the flat cable and a bending portion having a substantially L-shape to make contact with the mating connector.

4. A connector comprising:

a housing including a first fitting portion to which a flat cable is fitted and a second fitting portion to which a mating connector is fitted;

a first contact that includes a first contacting portion making contact with a front surface of the flat cable and a second contacting portion making contact with the mating connector; and a second contact that includes a third contacting portion making contact with a back surface of the flat cable and a fourth contacting portion making contact with the mating connector, the first contact and the second contact being held in the housing, wherein the first contact has a first arm portion and a second arm portion facing each other, one end of the first arm portion and one end of the second arm portion are connected to each other with a U-shaped portion, the U-shaped portion has a bending portion which is bent toward the mating connector to be fitted in a thickness direction of the flat cable, the flat cable is interposed in the thickness direction at a non-connection side of the first arm portion and the second arm portion, and the first contacting portion is provided at a tip of the first arm portion or in the vicinity of the tip of the first arm portion, the bending portion is positioned nearer the mating connector in the thickness direction of the flat cable than the non-connection side of the first arm portion and the second arm portion, the second contacting portion is formed on at least one of the first arm portion and the second arm portion of the bending portion, and the second contact has a substantially L-shape, the flat cable is interposed between the first contacting portion formed on the first arm portion of the first contact and the third contacting portion formed at one side of the second contact, and further the fourth contacting portion is formed between a tip of the other side of the second contact extending in the thickness direction of the flat cable and a bending portion having a substantially L-shape to make contact with the mating connector.

5. The connector according to any one of claims 2 to 4, wherein the second contact is insert-molded in the housing.

6. The connector according to any one of claims 1 to 4, wherein a shell component is provided to cover the housing.

7. A method of manufacturing the connector according to claim 1, the method comprising:

preparing the housing;

fitting the flat cable to the first fitting portion; and attaching the contact to the housing.

8. A method of manufacturing the connector according to any one of claims 2 to 4, the method comprising:

preparing the housing in which the second contact is provided;

fitting the flat cable to the first fitting portion; and attaching the first contact to the housing.

9. A flat cable with connector in which the flat cable is fitted to the first fitting portion of the connector according to any one of claims 1 to 4.

10. The flat cable with connector according to claim 9, wherein a shell component is provided to cover the housing.

* * * * *